US007021269B2

(12) United States Patent
Takahashi et al.

(10) Patent No.: US 7,021,269 B2
(45) Date of Patent: Apr. 4, 2006

(54) LOWER LINK OF PISTON CRANK MECHANISM FOR INTERNAL COMBUSTION ENGINE

(75) Inventors: Naoki Takahashi, Yokohama (JP); Kenshi Ushijima, Kanagawa (JP); Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 56 days.

(21) Appl. No.: 10/885,013

(22) Filed: Jul. 7, 2004

(65) Prior Publication Data

US 2005/0005897 A1 Jan. 13, 2005

(30) Foreign Application Priority Data

Jul. 8, 2003 (JP) ..... 2003-193305

(51) Int. Cl.
*F02D 15/02* (2006.01)

(52) U.S. Cl. ..... 123/197.3

(58) Field of Classification Search ..... 123/197.3, 123/197.4

See application file for complete search history.

(56) References Cited

U.S. PATENT DOCUMENTS 5,890,465 A * 4/1999 Williams ..... 123/197.4
2001/0017112 A1 8/2001 Moteki et al.
2004/0083992 A1* 5/2004 Nohara et al. ..... 123/78 E
2005/0045120 A1* 3/2005 Moteki et al. ..... 123/48 B

FOREIGN PATENT DOCUMENTS

JP 2000-54873 A 2/2000
JP 2001-227367 A 8/2001
JP 2002-61501 A 2/2002

* cited by examiner

*Primary Examiner*—Henry C. Yuen
*Assistant Examiner*—Jason Benton
(74) *Attorney, Agent, or Firm*—Foley & Lardner LLP

(57) ABSTRACT

A lower link of a double link type piston crank mechanism comprises a crank pin bearing housing portion that is adapted to receive a crank pin of a crankshaft and defines a first contour, an upper pin receiving bore portion that is adapted to receive an upper pin of an upper link and defines a second contour, a control pin receiving bore portion that is adapted to receive a control pin of a control link and defines a third contour, and a given portion that has therein an internally threaded bore formed in one of upper and lower half-parts of the lower link and a bored portion formed in the other of the upper and lower half-parts of the lower link, the given portion defining a fourth contour. The upper and lower half-parts are coupled by a bolt that passes through the bored portion and is engaged with the internally threaded bore. The lower link has further radially projected portions that extend radially outward beyond an imaginary minimum reference contour that is provided by connecting outer edge portions of the first, second, third and fourth contours with a continuous line.

11 Claims, 4 Drawing Sheets

LOWER LINK OF PISTON CRANK MECHANISM FOR INTERNAL COMBUSTION ENGINE

BACKGROUND OF THE INVENTION

1. Field of the Invention

The present invention relates in general to piston crank mechanisms for a reciprocating type internal combustion engine, and more particularly to a lower link of the piston crank mechanisms of a double link type.

2. Description of the Related Art

Hitherto, for connecting pistons of an internal combustion engine to a crankshaft of the same, various piston crank mechanism have been proposed and put into a practical use. Some of them are of a double link type, such as those disclosed in Laid-open Japanese Patent Applications (Tokkai) 2001-227367, 2002-61501 and 2000-54873. In the double link type piston crank mechanism of the published Applications 2001-227367 and 2002-61501, a lower link is employed through which an upper link pivotally connected to a piston through a piston pin and a crank pin of a crankshaft are pivotally connected. The pivotal connection between the lower link and the upper link is made through an upper pin. A control link is further employed which has one end pivotally connected to a fixed portion of an associated engine and the other end pivotally connected to the lower link. In the double link type piston crank mechanism of the other published Application 2000-54873, a control link is pivotally connected to an upper link, not to a lower link. That is, the mechanism comprises an upper link pivotally connected to a piston through a piston pin, a lower link pivotally disposed on a crank pin of a crankshaft and pivotally connected to the upper link, and a control link having one end pivotally connected to a fixed portion of an associated engine and the other end pivotally connected to the upper link.

SUMMARY OF THE INVENTION

As is understood from the above, the lower link of the double link type piston crank mechanisms functions to transmit a piston power produced as a result of a combustion in a cylinder to the crankshaft with the aid of the upper link and the control link. Thus, a high mechanical strength is needed by the lower link for standing the transmission of such piston power. Of course, the mechanical strength can be increased when the lower link has a bulky and thicker structure. However, in this case, the weight of the lower link is increased ironically, which exerts an undesired influence on a smoothed operation of the piston crank mechanism. Hitherto, various attempts have been carried out for overcoming such antinomical matter.

Accordingly, it is an object of the present invention to provide a light-weight and compact lower link for a double link type piston crank mechanism, which can assuredly transmit the piston power to the crankshaft irrespective of its light-weight compact construction.

In accordance with a first aspect of the present invention, there is provided a lower link for use in a piston crank mechanism of an internal combustion engine, the piston crank mechanism including an upper link that has one end pivotally connected to a piston through a piston pin, the lower link that is of a split type including upper and lower half-parts coupled by a bolt and is pivotally connected to the other end of the upper link through an upper pin and pivotally disposed on a crank pin of a crankshaft and a control link that has one end pivotally connected to a fixed portion of the engine and the other end pivotally connected to the lower link through a control pin. The lower link comprises a crank pin bearing housing portion adapted to receive the crank pin, the crank pin bearing housing portion defining a first contour; an upper pin receiving bore portion adapted to receive the upper pin, the upper pin receiving bore portion defining a second contour; a control pin receiving bore portion adapted to receive the control pin, the control pin receiving bore portion defining a third contour; a given portion that has therein an internally threaded bore formed in one of the upper and lower half-parts of the lower link and a bored portion formed in the other of the upper and lower half-parts of the lower link, the given portion defining a fourth contour, the upper and lower half-parts being coupled by the bolt that passes through the bored portion and is engaged with the internally threaded bore; and radially projected portions that extend radially outward beyond an imaginary minimum reference contour that is provided by connecting outer edge portions of the first, second, third and fourth contours with a continuous line.

In accordance with a second aspect of the present invention, there is provided a lower link for use in a piston crank mechanism of an internal combustion engine, the piston crank mechanism including an upper link that has one end pivotally connected to a piston through a piston pin, the lower link that is of a split type including upper and lower half-parts coupled by a bolt and is pivotally connected to the other end of the upper link through an upper pin and pivotally disposed on a crank pin of a crankshaft and a control link that has one end pivotally connected to a fixed portion of the engine and the other end pivotally connected to the lower link through a control pin. The lower link comprises a crank pin bearing housing portion adapted to receive the crank pin, the crank pin bearing housing portion defining a first contour; an upper pin receiving bore portion adapted to receive the upper pin, the upper pin receiving bore portion defining a second contour; a control pin receiving bore portion adapted to receive the control pin, the control pin receiving bore portion defining a third contour; a given portion that has therein an internally threaded bore formed in one of the upper and lower half-parts of the lower link and a bored portion formed in the other of the upper and lower half-parts of the lower link, the given portion defining a fourth contour, the upper and lower half-parts being coupled by the bolt that passes through the bored portion and is engaged with the internally threaded bore; and first, second and third radially projected portions that extend radially outward beyond an imaginary minimum reference contour that is provided by connecting outer edge portions of the first, second, third and fourth contours with a continuous line, the first radially projected portion having an apex that is positioned at the side of the upper pin receiving portion with respect to a normal bisector of a straight line segment that connects a center of the upper pin receiving portion and a center of the crank pin bearing housing portion, the second radially projected portion having an apex that is positioned at the side of the control pin receiving bore portion with respect to a normal bisector of a straight line segment that connects a center of the control pin receiving bore portion and the center of the crank pin bearing housing portion, and the third radially projected portion being positioned at an outer side of the upper pin receiving bore portion.

DETAILED DESCRIPTION OF THE INVENTION

In the following, the present invention will be described in detail with reference to the accompanying drawings.

For ease of understanding, various directional terms, such as upper, lower, right, left, upward and the like are used in the description. However, such terms are to be understood with respect to a drawing or drawing on which a corresponding part or portion is shown.

Figure 1:
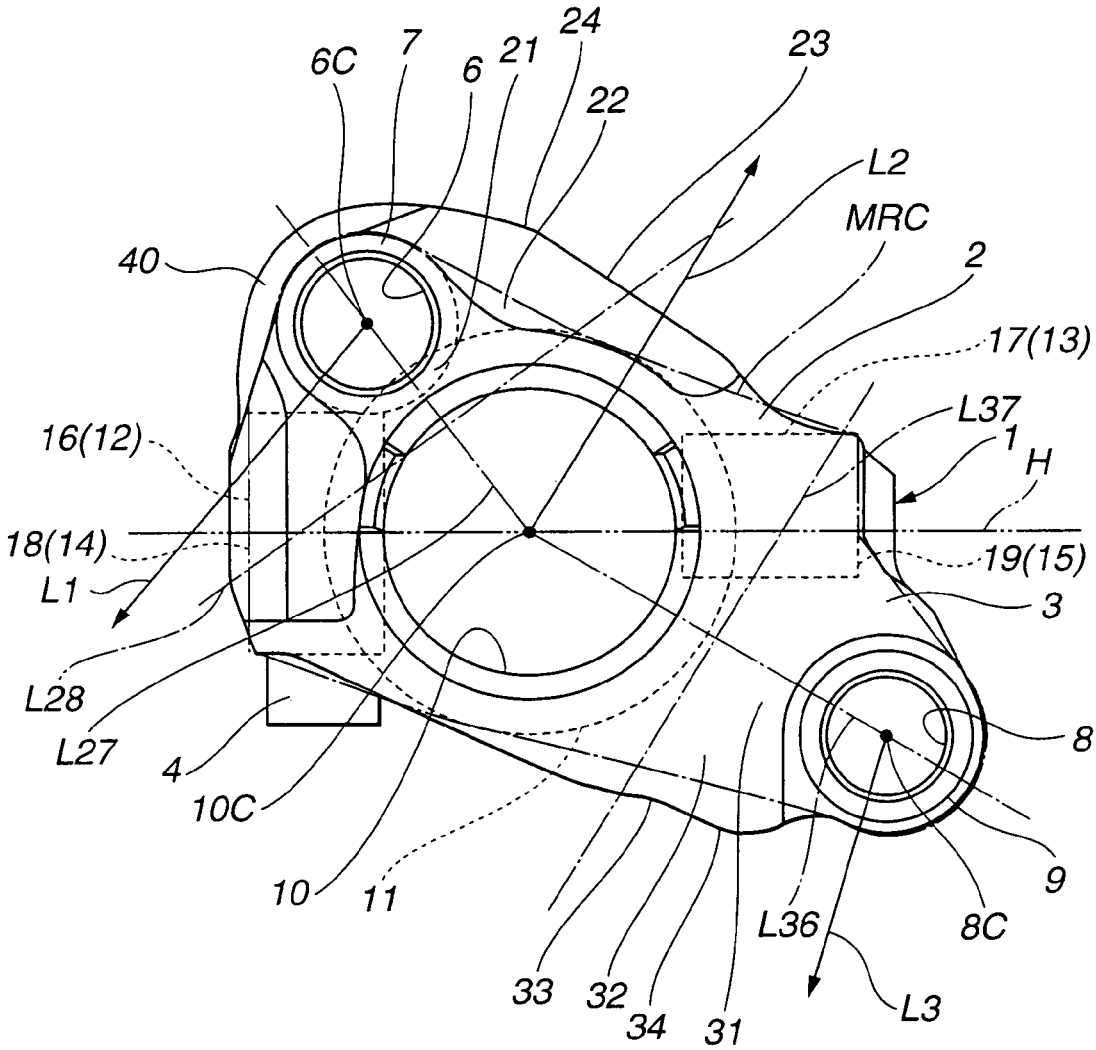
FIG. 1 is a front view of a lower link of the present invention.
Figure 2:
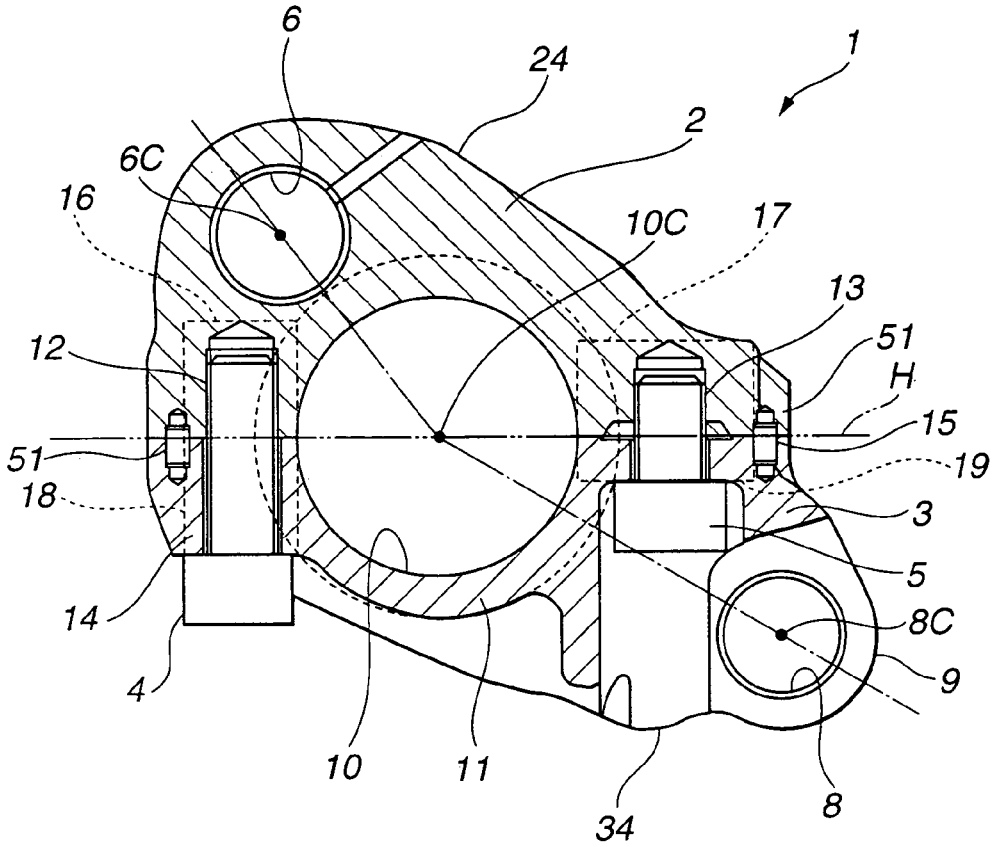
FIG. 2 is a sectional view of the lower link of the invention, that is taken along the line "II—II" of FIG. 3.

Referring to the accompanying drawings, particularly FIGS. 1 and 2, there is shown a lower link 1 of the present invention.

This lower link 1 is used as an element of a double link type piston crank mechanism, such as the mechanism described in the above-mentioned Laid-open Japanese Patent Applications.

Figure 3:
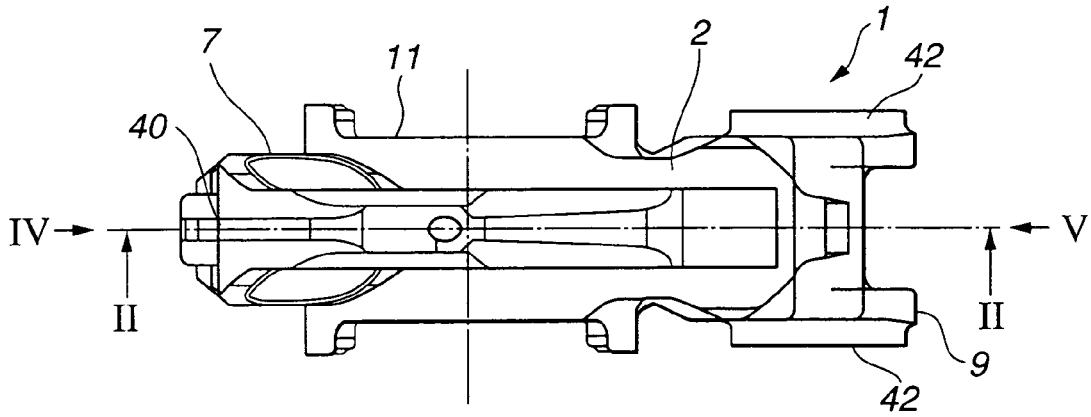
FIG. 3 is a top view of the lower link of the invention.

As is seen from FIG. 2 which is a sectional view taken along the line "II—II" of FIG. 3, the lower link 1 has a split construction, including an upper half-part 2 and a lower half-part 3 which are tightly coupled by means of two bolts 4 ad 5 at mutually mating surfaces indicated by the phantom line "H".

When lower link 1 is properly set with respect to an associated internal combustion engine (not shown), upper half-part 2 and lower half-part 3 of lower link 1 are arranged at upper and lower positions in an associated crankcase (not shown), and two bolts 4 and 5 are arranged to connect the upper and lower half-parts 2 and 3 from a lower position in the crankcase. Denoted by numerals 51 and 51 are locating pins for achieving mutual positioning between upper and lower half-parts 2 and 3.

Denoted by numeral 6 is a pin bore into which an upper pin (not shown) of an upper link (not shown) is inserted for achieving a pivotal connection between lower link 1 and the upper link.

As is seen from FIGS. 1 and 3, pin bore 6 is defined by an annular boss portion 7 integrally formed on an upper portion of lower link 1.

The upper link incorporated with lower link 1 of the invention has a forked lower end including two spaced arms that has aligned pin bores for receiving the upper pin. The aligned pin bores of the two spaced arms have chamfered inside ends by which opposed outer surface portions of annular boss portion 7 of lower link 7 are rotatably held.

Referring back to FIG. 2, denoted by numeral 8 is a pin bore into which a control pin (not shown) of a control link (not shown) is inserted for achieving a pivotal connection between lower link 1 and the control link.

As is seen from FIGS. 1 and 3, pin bore 8 is defined by an annular boss portion 9 integrally formed on a lower portion of lower link 1. More specifically, as is seen from FIG. 3, annular boss portion 9 has a forked end including two spaced walls 42 that have aligned pin bores for receiving the control pin. The aligned pin bores of two spaced walls 42 have chamfered inside ends by which opposed outer surface portions of an annular boss formed on the control link are rotatably held.

Referring back to FIG. 2, denoted by numeral 10 is a pin bore into which a crank pin (not shown) of a crankshaft (not shown) is inserted for achieving a pivotal connection between lower link 1 and the crankshaft.

It is to be noted that the split line "H" of lower link 1 at which upper and lower half-parts 2 and 3 are split passes a center 10C of the pin bore 10.

As is seen from FIGS. 1 and 2, pin bore 10 for crank pin is defined by an annular bearing housing portion 11 that is integrally formed on a middle portion of lower link 1.

As is understood from FIG. 3, annular bearing housing portion 11 has a thickness larger than that of annular boss portion 7 for the upper link. Due to the larger thickness, the annular bearing housing portion 11 has a satisfied rigidity.

As is seen from FIG. 2, for receiving the two bolts 4 and 5, upper half-part 2 of lower link 1 is formed with two internally threaded bores 12 and 13 and lower half-part 3 of lower link 1 is formed with two bored portions 14 and 15 which are compressed when two bolts 4 and 5 are tightly engaged with threaded bores 12 and 13 of upper half-part 2.

Portions 16 and 17 of upper half-part 2 that have the internally threaded bores 12 and 13 and portions 18 and 19 of lower half-part 3 that have the bored portions 14 and 15 are each formed to have a certain thickness for withstanding a marked stress that is applied to such portions when two bolts 4 and 5 are tightly engaged with threaded bores 12 and 13 of upper half-part 2.

As is understood from FIG. 1, such portions 16, 17, 18 and 19 are bulged, that is, such portions 16, 17, 18 and 19 are shaped much thicker than a general portion of lower link 1. As shown, each of the portions 16, 17, 18 and 19 is generally rectangular in shape when viewed from an axial direction of the crank pin associated with lower link 1.

In order to clarify the feature of the present invention, description will be directed to "minimum reference contour" MRC that is possessed by conventional lower links such as those disclosed by the above-mentioned Laid-open Japanese Patent Applications.

For providing lower link 1 of the invention with a satisfied rigidity and a reliable dimensional stability, lower link 1 has also minimum reference contour MRC.

That is, as is indicated by a chain line in FIG. 1, in case of lower link 1, the minimum reference contour MRC is defined by a continuous straight line that passes an outer edge portion of annular boss portion 7 for the upper pin, that of annular boss portion 9 for the control pin, that of bearing housing portion 11 for the crank pin, that of portions 16 and 17 for internally threaded bores 12 and 13, and that of portions 18 and 19 for bored portions 14 and 15.

It is to be noted that in case of the above-mentioned conventional lower links, there are substantially no portions that extend radially outward beyond the minimum reference contour MRC.

However, as is seen from FIG. 1, in the present invention, the lower link 1 has further portions that are positioned outside of the minimum reference contour MRC. That is, a middle section 21 that integrally connects annular boss portion 7 for the upper pin and bearing housing portion 11 for the crank pin has, at a section thereof facing an associated piston (not shown), a zone 22 that has a projected portion 23 that projects radially outward from the minimum reference contour MRC.

It is to be noted that an apex 24 of the projected portion 23 (that is, the point where the maximum distance is provided between the minimum reference contour MRC and the projected portion 23) is positioned at the side of the pin bore 6 (or upper pin) with respect to a normal bisector L28 of a straight line segment L27 that connects a center 6C of pin bore 6 (or upper pin) and the center 10C of pin bore 10 (or crank pin).

Due to provision of the projected portion 23 that has the above-mentioned geometrical feature, the following advantage is obtainable.

That is, when, under combustion stroke of an associated piston, a load indicated by the arrow L1 is applied from the upper pin rotatably received in pin bore 6 to lower link 1 and at the same time a load indicated by the arrow L2 is applied from the crank pin rotatably received in pin bore 10 to lower link 1, the middle section 21 of lower link 1 that connects the annular boss portion 7 for the upper pin and bearing housing portion 11 for the crank pin is subjected to a certain shearing load. However, due to provision of zone 22 with the projected portion 23, that is, because such shearing load is appropriately supported by a larger portion of lower link 1 that is defined between straight line segment L27 and projected portion 23, undesirable deformation and damage of lower link 1 are suppressed or at least minimized.

As is seen from FIG. 1, another middle section 31 that integrally connects annular boss portion 9 for the control pin and bearing housing portion 11 for the crank pin has, at a section thereof facing a base part of the associated control link (not shown), a zone 32 that has a projected portion 33 that projects radially outward from the minimum reference contour MRC.

It is to be noted that an apex 34 (that is, the point where the maximum distance is provided between the minimum reference contour MRC and the projected portion 33) is positioned nearer to the pin bore 8 (or control pin) than a normal bisector L37 of a straight line segment L36 that connects a center 8C of pin bore 8 (or control pin) and the center 10C of pin bore 10 (or crank pin) is.

Due to provision of the projected portion 33 that has the above-mentioned geometrical feature, the following advantage is obtainable.

That is, when, under combustion stroke of an associated piston, a load indicated by the arrow L3 is applied from the crank pin rotatably received in pin bore 8 to lower link 1 and at the same a load indicated by the arrow L2 is applied from the crank pin rotatably received in pin bore 10 to lower link 1, the middle section 31 is subjected to a tension load (or tensile stress). Due to this tension load, annular boss portion 9 for the control pin tends to show a deformation in the direction of the arrow L3, and thus, the two spaced walls 42 that constitute the forked end of annular boss portion 9 tend to induce an inward deformation thereof. However, in the present invention, such inward deformation of the two spaced walls 42 is suppressed or at least minimized due to provision of the projected portion 33 mentioned hereinabove.

Figure 6:
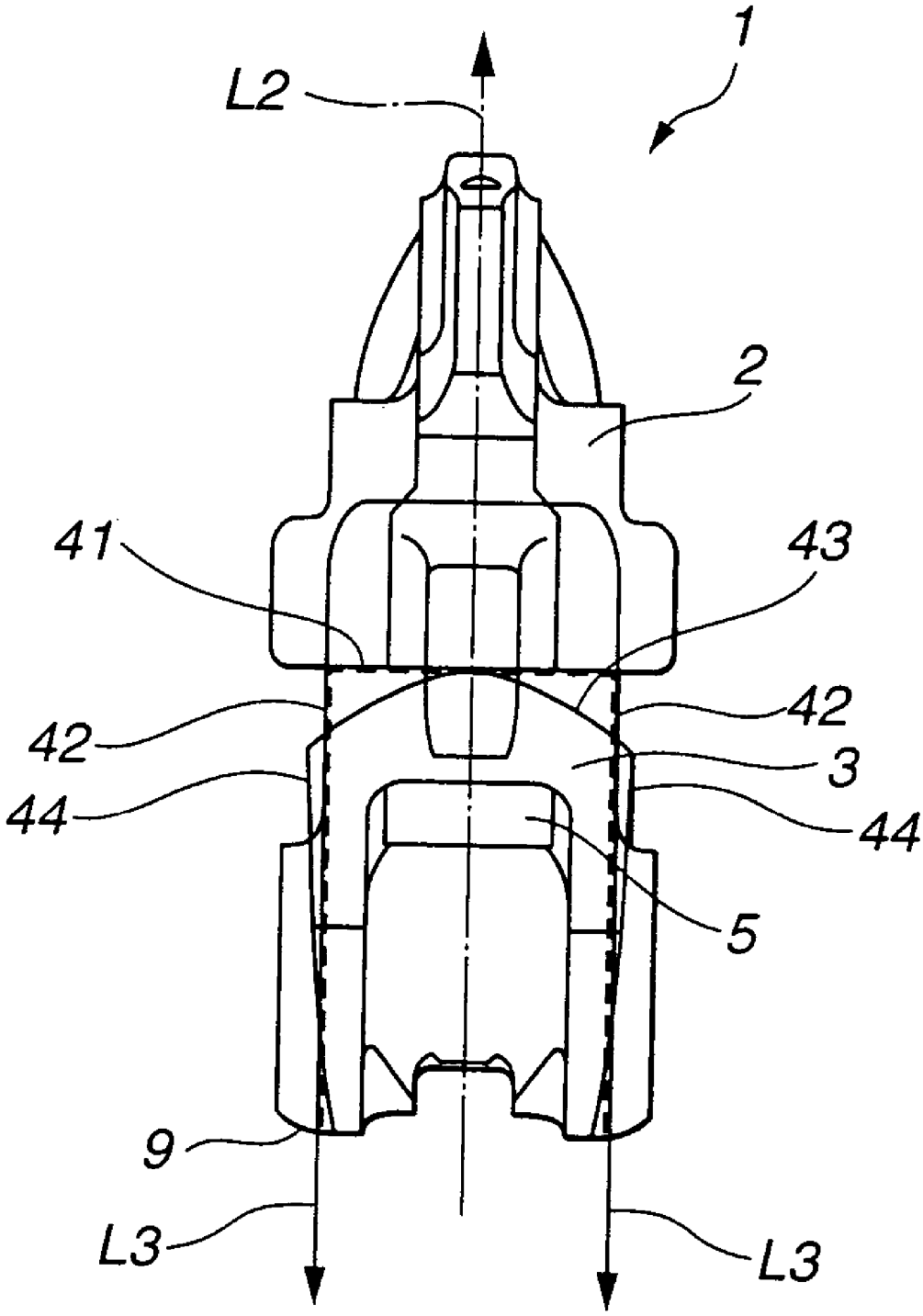
FIG. 6 is a view similar to FIG. 5, but showing a condition wherein a certain load is applied to the lower link of the invention from a crank pin of a crankshaft.

The inward deformation of the two spaced walls 42 of annular boss portion 9 will be discussed in detail with reference to FIG. 6.

When no external force is applied to the two spaced walls 42 of the annular boss portion 9, the structure that surrounds annular boss portion 9 shows such a condition that two spaced walls 42 extend downward straightly from a straight mating surface (indicated by broken line 41) of lower half-part 3 of lower link 1 at which the upper half-part 2 of lower link 1 contacts lower half-part 3. While, when an external force is applied to two spaced walls 42, mating surface 41 of lower half-part 3 that contacts upper half-part 2 is curved to become convex in shape as is exaggeratedly shown by solid line 43. With such convex shaping of mating surface 41, two spaced walls 42 are deformed inward toward each other as is exaggeratedly shown by solid lines 44.

However, in the present invention, due to provision of the projected portion 33, the undesired inward deformation of two spaced walls 42 is suppressed or at least minimized. In other words, the portion of lower link 1 that surrounds the apex 34 serves as a reinforcing means of the annular boss portion 9 of lower link 1.

As is seen from FIG. 1, pin bore 10 for the crank pin is formed in an area of lower link 1 where a center of gravity is provided. This is advantageous for reducing undesired vibration of lower link 1 relative to the crank pin.

As is seen from FIG. 1, the projected portion 23 and the other projected portion 33 are arranged at generally opposite positions with respect to the center 10C of pin bore 10 for the crank pin. This arrangement promotes reduction of the undesired vibration of lower link 1.

Figure 4:
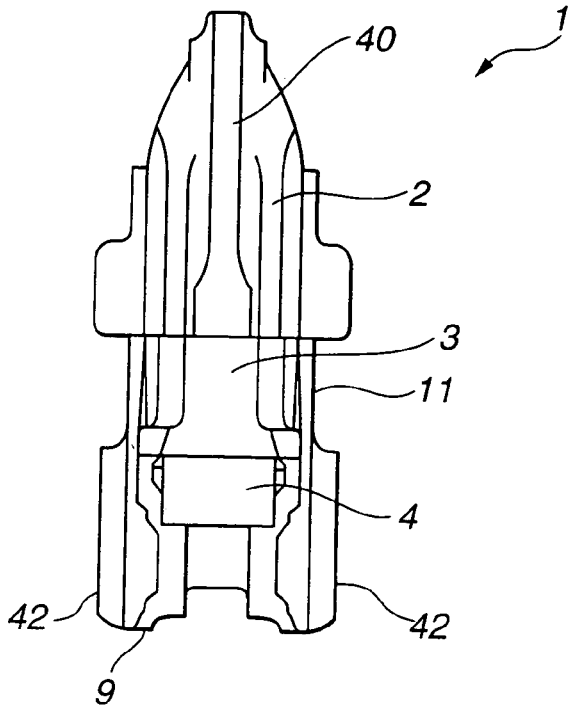
FIG. 4 is a left side view of the lower link of the invention, that is taken from the direction of the arrow "IV" of FIG. 3.
Figure 5:
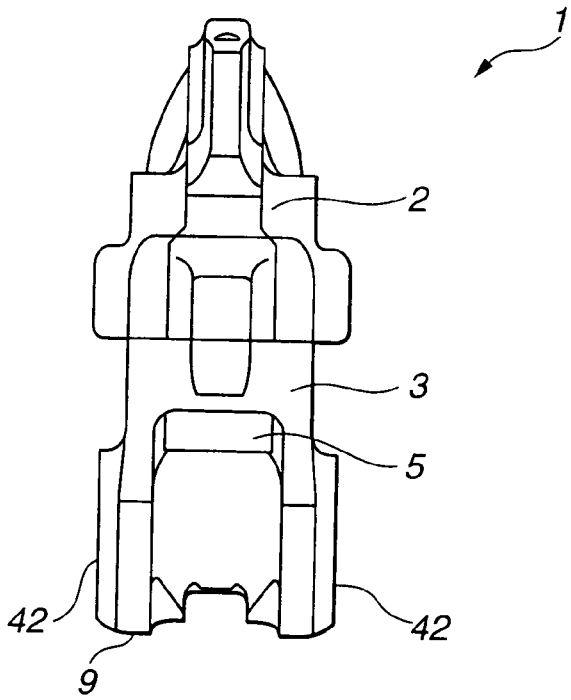
FIG. 5 is a right side view of the lower link of the invention, that is taken from the direction of the arrow "V" of FIG. 3.

As is seen from FIG. 1, lower link 1 is integrally formed, at an outer side of annular boss portion 7 for the upper pin, with a projected portion 40. That is, projected portion 40 is located on an extended part of the straight line segment L27 that connects a center 6C of pin bore 6 for the upper pin and center 10C of pin bore 10 for the crank pin. As is seen from FIGS. 3 and 4, projected portion 40 is thinner than the annular boss portion 7.

Due to provision of projected portion 40 that has the above-mentioned geometrical feature, the following advantage is obtainable.

That is, when, under combustion stroke of the associated piston, a load indicated by the arrow L1 is applied from the upper pin rotatably received in pin bore 6 to lower link 1, annular boss portion 7 is subjected to a tension load (or tensile stress). Due to this tension load, annular boss portion 7 for the upper pin tends to show a deformation in the direction of the arrow L1. However, in the present invention, such deformation is suppressed or at least minimized by the provision of the projected portion 40. Furthermore, due to the thinner structure of such projected portion 40, weight of lower link 1 and moment of inertia of the same can be reduced. It is to be noted that providing lower link 1 with such projected portion 40 is more effective in increasing the rigidity of lower link 1 than increasing the diameter of annular boss portion 7 so long as such two measures cause an even increase in weight of lower link 1. This is because the provision of such projected portion 40 brings about a higher modulus of section than the diameter increase of annular boss portion 7.

The entire contents of Japanese Patent Application 2003-193305 filed Jul. 8, 2003 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A lower link for use in a piston crank mechanism of an internal combustion engine, the piston crank mechanism including an upper link that has one end pivotally connected to a piston through a piston pin, the lower link that is of a split type including upper and lower half-parts coupled by a bolt and is pivotally connected to the other end of the upper link through an upper pin and pivotally disposed on a crank pin of a crankshaft and a control link that has one end pivotally connected to a fixed portion of the engine and the other end pivotally connected to the lower link through a control pin, the lower link comprising:

a crank pin bearing housing portion adapted to receive the crank pin, the crank pin bearing housing portion defining a first contour;

an upper pin receiving bore portion adapted to receive the upper pin, the upper pin receiving bore portion defining a second contour;

a control pin receiving bore portion adapted to receive the control pin, the control pin receiving bore portion defining a third contour;

a given portion that has therein an internally threaded bore formed in one of the upper and lower half-parts of the lower link and a bored portion formed in the other of the upper and lower half-parts of the lower link, the given portion defining a fourth contour, the upper and lower half-parts being coupled by the bolt that passes through the bored portion and is engaged with the internally threaded bore; and radially projected portions that extend radially outward beyond an imaginary minimum reference contour that is provided by connecting outer edge portions of the first, second, third and fourth contours with a continuous line.

2. The lower link as claimed in claim 1, in which the crank pin bearing housing portion, the upper pin receiving bore portion and the control pin receiving bore portion are each formed to have a cylindrical bore to rotatably receiving therein the corresponding pin.

3. The lower link as claimed in claim 1, in which the fourth contour defined by the given portion has a size that is larger than that of a contour defined by the corresponding bolt.

4. The lower link as claimed in claim 1, in which an apex of one of the radially projected portions is positioned at the side of the upper pin receiving portion with respect to a normal bisector of a straight line segment that connects a center of the upper pin receiving portion and a center of the crank pin bearing housing portion.

5. The lower link as claimed in claim 4, in which the apex of the radially projected portion is positioned to face a back side of a corresponding piston of the engine.

6. The lower link as claimed in claim 1, in which an apex of one of the radially projected portions is positioned at the side of the control pin receiving bore portion with respect to a normal bisector of a straight line segment that connects a center of the control pin receiving bore portion and a center of the crank pin bearing housing portion.

7. The lower link as claimed in claim 6, in which the apex of the radially projected portion is positioned to face toward a lower end of the control link that is pivotally connected to a fixed member of the engine.

8. The lower link as claimed in claim 1, in which:

an apex of one of the radially projected portions is positioned at the side of the upper pin receiving portion with respect to a normal bisector of a straight line segment that connects a center of the upper pin receiving portion and a center of the crank pin bearing housing portion, and in which, an apex of the other one of the radially projected portions is positioned at the side of the control pin receiving bore portion with respect to a normal bisector of a straight line segment that connects a center of control pin receiving bore portion and a center of the crank pin bearing housing portion.

9. The lower link as claimed in claim 8, in which still another one of the radially projected portions is positioned at an outer side of the upper pin receiving bore portion.

10. The lower link as claimed in claim 9, in which the still another one of the radially projected portions is thinner than the upper pin receiving bore portion.

11. A lower link for use in a piston crank mechanism of an internal combustion engine, the piston crank mechanism including an upper link that has one end pivotally connected to a piston through a piston pin, the lower link that is of a split type including upper and lower half-parts coupled by a bolt and is pivotally connected to the other end of the upper link through an upper pin and pivotally disposed on a crank pin of a crankshaft and a control link that has one end pivotally connected to a fixed portion of the engine and the other end pivotally connected to the lower link through a control pin, the lower link comprising:

a crank pin bearing housing portion adapted to receive the crank pin, the crank pin bearing housing portion defining a first contour;

an upper pin receiving bore portion adapted to receive the upper pin, the upper pin receiving bore portion defining a second contour;

a control pin receiving bore portion adapted to receive the control pin, the control pin receiving bore portion defining a third contour;

a given portion that has therein an internally threaded bore formed in one of the upper and lower half-parts of the lower link and a bored portion formed in the other of the upper and lower half-parts of the lower link, the given portion defining a fourth contour, the upper and lower half-parts being coupled by the bolt that passes through the bored portion and is engaged with the internally threaded bore; and first, second and third radially projected portions that extend radially outward beyond an imaginary minimum reference contour that is provided by connecting outer edge portions of the first, second, third and fourth contours with a continuous line, the first radially projected portion having an apex that is positioned at the side of the upper pin receiving portion with respect to a normal bisector of a straight line segment that connects a center of the upper pin receiving portion and a center of the crank pin bearing housing portion, the second radially projected portion having an apex that is positioned at the side of the control pin receiving bore portion with respect to a normal bisector of a straight line segment that connects a center of the control pin receiving bore portion and the center of the crank pin bearing housing portion, and the third radially projected portion being positioned at an outer side of the upper pin receiving bore portion.

* * * * *